US005524879A

United States Patent [19]

Lyle

[11] Patent Number: 5,524,879

[45] Date of Patent: Jun. 11, 1996

[54] ADJUSTABLE RACKET HANDLE

[76] Inventor: Janet Lyle, 1351 McPherson, Council Bluffs, Iowa 51503

[21] Appl. No.: 383,834

[22] Filed: Feb. 6, 1995

[51] Int. Cl.[6] ..... A63B 49/08

[52] U.S. Cl. ..... 273/735; 473/299

[58] Field of Search ..... 273/73 R, 73 J, 273/75, 81 R, 81.2, 81 C

[56] References Cited

U.S. PATENT DOCUMENTS

| | | | |
|---|---|---|---|
| 2,107,983 | 2/1938 | Hamilton | 273/81.2 |
| 3,102,726 | 9/1963 | Barrett | 273/81.2 |
| 3,524,646 | 8/1970 | Wheeler | 273/81.2 |
| 3,833,219 | 9/1974 | Dean | 273/73 J X |
| 3,931,968 | 1/1976 | Hedberg | 273/73 J X |
| 4,101,125 | 7/1978 | Heath | 273/73 J X |
| 4,149,721 | 4/1979 | Strickland | 273/73 J |
| 4,545,584 | 10/1985 | Adam | 273/73 J |
| 4,641,838 | 2/1987 | Gabrielidis | 273/73 J |
| 5,282,619 | 2/1994 | Napolitano et al. | 273/81.2 X |

FOREIGN PATENT DOCUMENTS

| | | | |
|---|---|---|---|
| 2662948 | 12/1991 | France | 273/73 J |
| 2030998 | 12/1971 | Germany | 273/73 J |
| 1338255 | 11/1973 | United Kingdom | 273/81.2 |

*Primary Examiner*—William E. Stoll
*Attorney, Agent, or Firm*—Terrance L. Siemens

[57] ABSTRACT

An improved construction for the interengagement of the racket head portion and the handle portion of a racket is disclosed. The construction is such that the overall length of the racket can be easily varied. Additionally, the improved construction described includes a locking and unlocking feature that makes the inadvertent release or disengagement of one from the other extremely unlikely. The shank extending from the racket head includes a plurality of notches. The shank fits inside the handle and grip portion of the assembly. Exteriorly of both the handle portion and the enclosed shank lies a surrounding locking slide. A ball detent retaining means holds the slide in the locked or unlocked position in relation to the handle portion. When in the unlocked position, the handle portion and the locking slide are movable in relation to the shank, and a biased roller attached to the handle portion selectively engages the notches in the shank to allow for easy overall length adjustment.

1 Claim, 3 Drawing Sheets

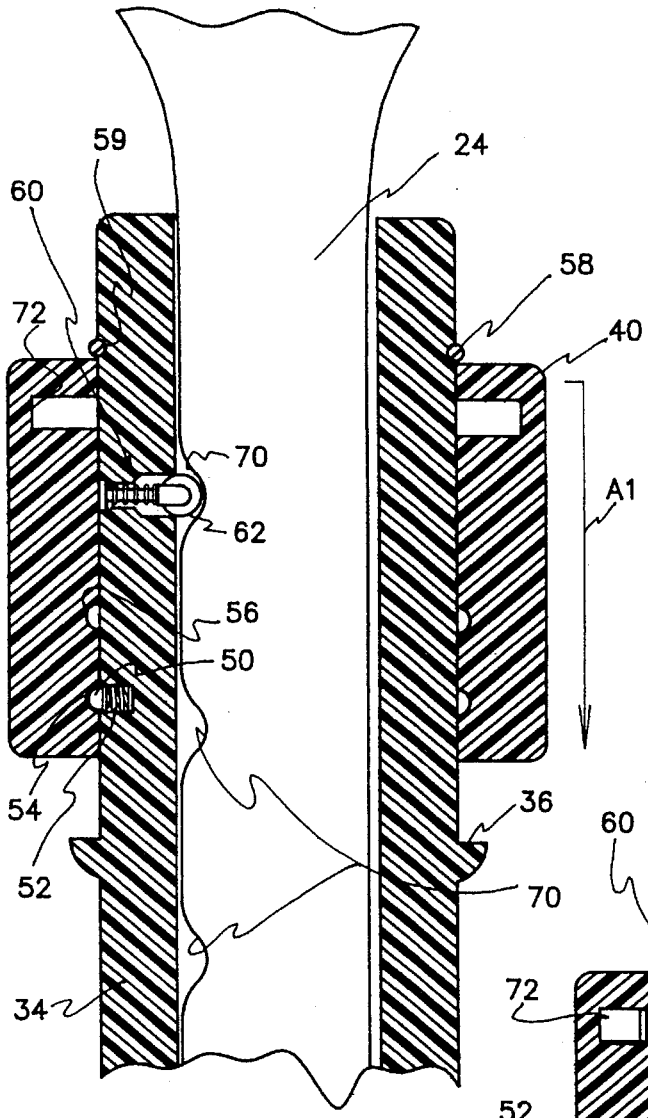
FIG. 2
FIG. 3
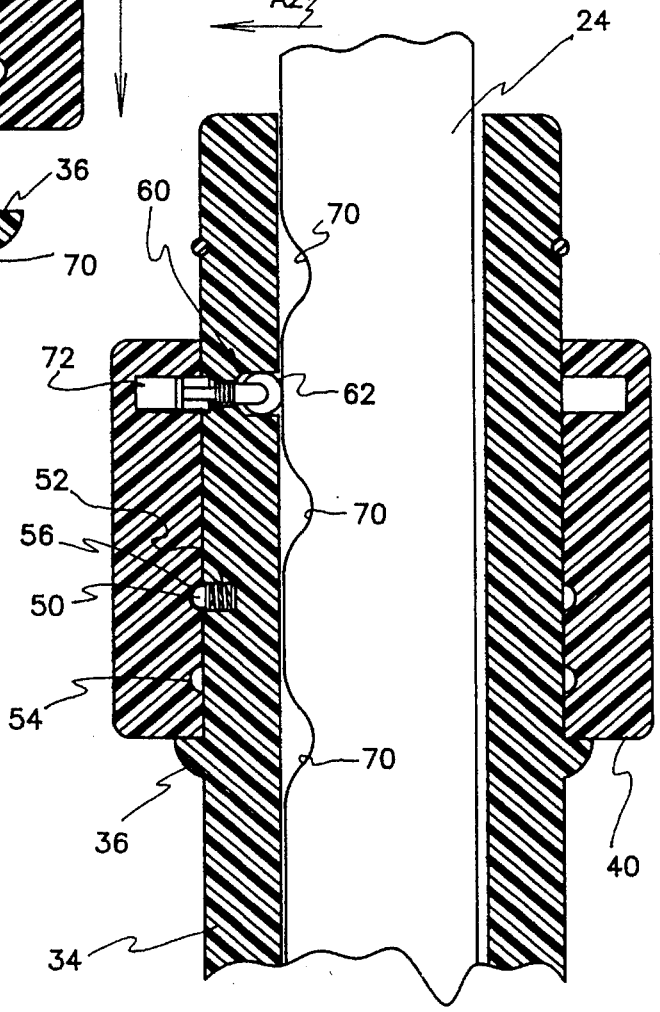

ADJUSTABLE RACKET HANDLE

BACKGROUND OF THE INVENTION

1. Field of the Invention

The present invention relates to sports. More specifically, it relates to an improved racket handle construction wherein the length between the gripping portion and the racket or object engaging portion of the device can be easily and safely changed. More generally, it relates to any application where a quick change in the length of an elongate object is desired, such as in a collapsible flagpole, a cheerleader's baton, or even a temporary load bearing support, for instance.

Thus it can be seen that the potential fields of use for this invention are myriad and the particular preferred embodiment described herein is in no way meant to limit the use of the invention to the particular field chosen for exposition of the details of the invention.

A comprehensive listing of all the possible fields to which this invention may be applied is limited only by the imagination and is therefore not provided herein. Some of the more obvious applications are mentioned herein in the interest of providing a full and complete disclosure of the unique properties of this previously unknown general purpose article of manufacture. It is to be understood from the outset that the scope of this invention is not limited to these fields or to the specific examples of potential uses presented hereinafter.

2. Description of the Prior Art

There are a large number of sports where an elongate utensil or tool is used to strike or engage a ball or like object. Elementary physics tells us that the greater the distance between the grip of the tool and the engaging portion, the more force can be applied to striking the object. Additionally, if the point of the game is to engage or catch the object in question, the longer reach is useful. A number of sports have differently sized sticks or rackets for different positions, with lacrosse being one example. Another useful aspect of having an adjustable racket is that various lengths can be gradually used to develop hand-eye coordination. A need exists for a handle construction that allows the user to easily change the length and that additionally provides safety features so that the grip and racket cannot inadvertently come apart when the user is swinging. A number of related U.S. Patents were uncovered during a search at the Patent and Trademark Office and they are discussed hereinafter:

U.S. Pat. No. 3,968,965 issued to Richard E. Frenkel et al. on Jul. 13, 1976 discloses a game racket wherein a detachable handle includes radially extending camming surfaces that cooperate with radially movable wall plates to allow the user to adjust the diameter of the handle. This is dissimilar from the present invention in that there is no teaching of the biased detent means or the locking means required by the instant invention.

U.S. Pat. No. 4,545,584 issued to Günter Adams on Oct. 8, 1985 discloses a racket with an adjustable handle. In this invention, the handle itself is made up of a pair of half-shells that fit over the shaft and are held there by means of an elastic strip, an elastic tube, or tube sections. An adjustment screw is inserted into a threaded borehole, and thus the location of the handle portion can be moved longitudinally on the shaft. Unlike the present invention, the outer locking and unlocking sliding portion with its biased ball detent positioning means is not shown.

And lastly, in U.S. Pat. No. 4,641,838 issued to Pericles Gabrielidis on Feb. 10, 1987 there is disclosed a tennis racket with an adjustable handle. The handle portion is made up of two C-shaped members that clamp over the shank. A flexible grip material is then wrapped around the clamping members to secure them in the proper position. Unlike the instant invention, no locking or unlocking mechanism is shown to streamline the adjustment procedure.

None of the above inventions and patents, taken either singly or in combination, is seen to describe the instant invention as claimed.

SUMMARY OF THE INVENTION

Briefly, the invention comprises an improved construction for the interengagement of the racket head portion and the handle portion of a racket such that they overall length of the construction can be easily varied. Additionally, the improved construction described herein includes a locking and unlocking feature that makes the inadvertent release or disengagement of one from the other extremely unlikely. The shank extending from the racket head includes a plurality of notches. The shank fits inside the handle and grip portion of the assembly. Exteriorly of the both the handle portion and the enclosed shank lies a surrounding locking slide. A ball detent retaining means holds the slide in the locked or unlocked position in relation to the handle portion. When in the unlocked position, the handle portion and the locking slide are movable in relation to the shank, and a biased roller attached to the handle portion selectively engages the notches in the shank to allow for easy overall length adjustment.

Accordingly, it is a principal object of the invention to provide a new and improved adjustable racket handle which overcomes the disadvantages of the prior art in a simple but effective manner.

It is a major object of this invention to provide an adjustable racket handle which allows a user to easily and quickly vary the overall length of the racket.

It is another object of the invention to provide an adjustable racket handle wherein the racket portion with its shank and the handle portion with its grip are telescopically interengaged.

It is another object of the invention to provide an adjustable racket handle wherein a locking sleeve overlying both the racket portion shank and the handle portion is movable to a locked or an unlocked position for use or adjustment, respectively.

Yet another object of the invention is to provide an adjustable racket handle wherein the overlying sleeve has a pair of apertures on the inner surface thereof to variously engage a ball detent when the sleeve is moved to the locked and unlocked position.

Still yet another object of the invention is to provide an adjustable racket handle where the overall length of the racket is adjustable through the interengagement of a biased roller fixed to the handle portion and a plurality of notches in the racket shank.

Finally, it is a general goal of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

The present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 2 is a cross sectional view taken along line 2—2 of FIG. 1 showing the locking sleeve in the locked position.

FIG. 3 is a cross sectional view taken along line 2—2 of FIG. 1 showing the locking sleeve in the open position.

DETAILED DESCRIPTION OF THE PREFERRED EMBODIMENTS

Figure 1:
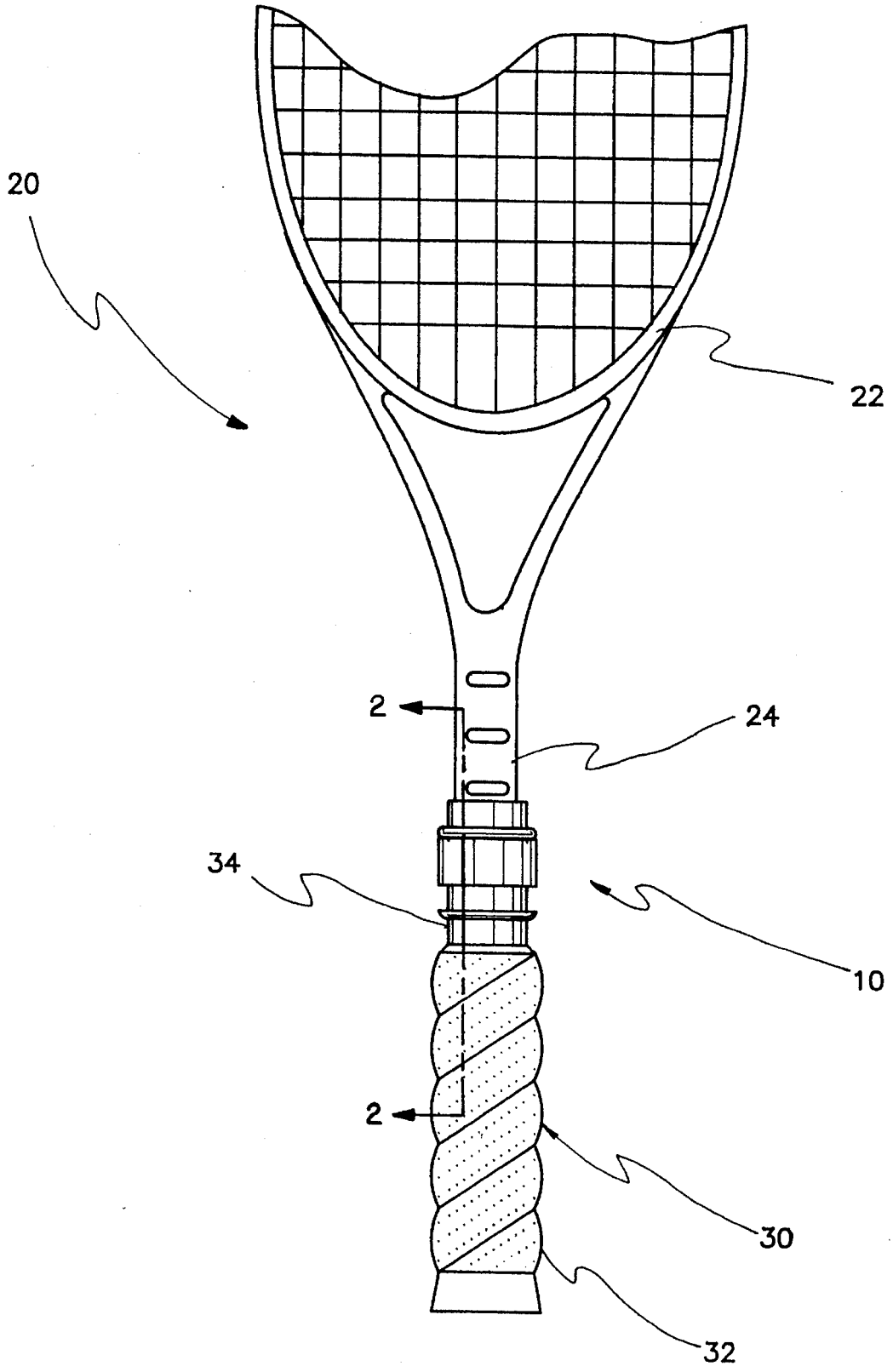
FIG. 1 is a perspective view of the present invention.

The present invention is indicated at 10 in FIG. 1. The adjustable racket handle basically comprises three main parts. The racket portion 20 includes that racket head 22 and the racket shank 24. The grip portion 30 includes that grip 32 itself, and the substantially hollow racket shank receiving portion 34. The overlying locking sleeve 40 fits snugly over the handle and is movable, as will be discussed further.

Referring now to FIGS. 2 and 3, the locking/unlocking of the device 10 will now be discussed. FIG. 2 shows the unit in the locked position. Ball detent means 50, mounted in the racket shaft receiving portion 34 is urged outwardly by biasing means 52. The ball detent 50 is engageable with either locking position aperture 54 or unlocked position aperture 56. FIG. 2 shows the device 10 in the locked position. In this position, a biased roller 60 engages one of a plurality of notches 70. The roller portion 62 is urged into the notch 70 by a pair of roller assembly springs 64 (best seen in FIGS. 3 and 4) More details of the biased roller will be discussed below. In the preferred embodiment of the invention, there is a flexible O-ring seal 58 that is placed exteriorly of the racket shaft receiving portion 34 of the grip portion 30. This aids the interengaged biased roller 60 and notch 70 in keeping the racket portion 20 and the grip portion 30 in the desired relationship relative to one another. The O-ring seal 58 fits into an annular exterior groove 59 in the racket receiving portion 34. Thus, when the device 10 is in the position seen in FIG. 2, the major elongate portions 20, 30 of the device are held in a fixed relationship to one another. When the user wishes to change the length of the racket, the locking sleeve 40 is moved in the direction indicated by arrow A1 in FIG. 2. The ball detent means 50 disengages from locking aperture 54 and, as the locking sleeve butts up against the locking sleeve travel stop flange 36, ball detent 50 engages the unlocked position aperture 56. This subsequent engagement would provide the user with a tactile clue or "click" to ensure them that they have reached the correct position. The device 10 is now in the configuration shown in FIG. 3. Ball detent 50 is now in the unlocked position aperture 56.

Figure 4:
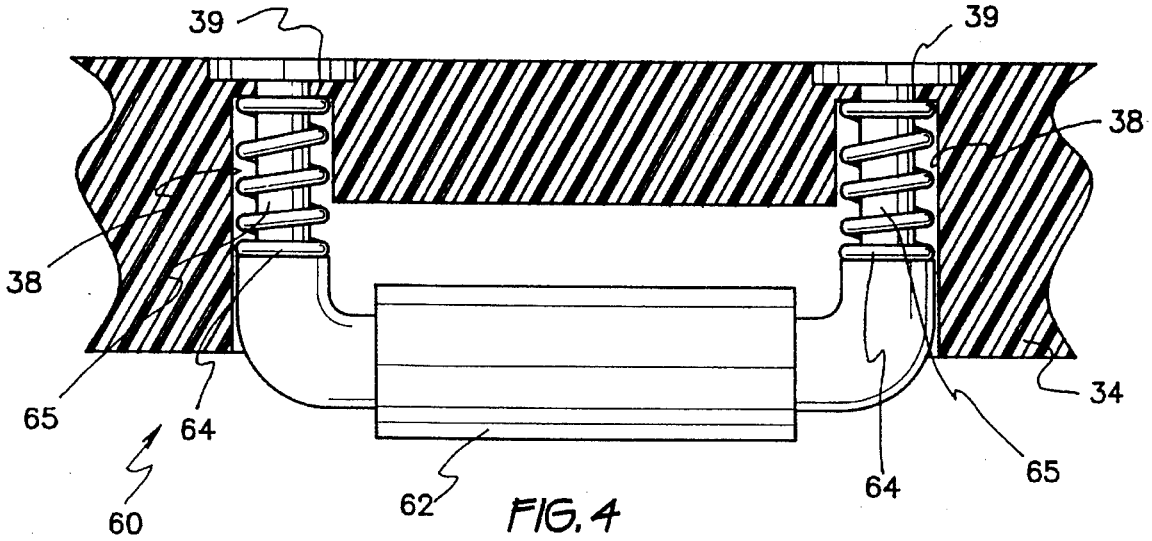
FIG. 4 is a partial enlarged view of the biased roller.
Figure 5:
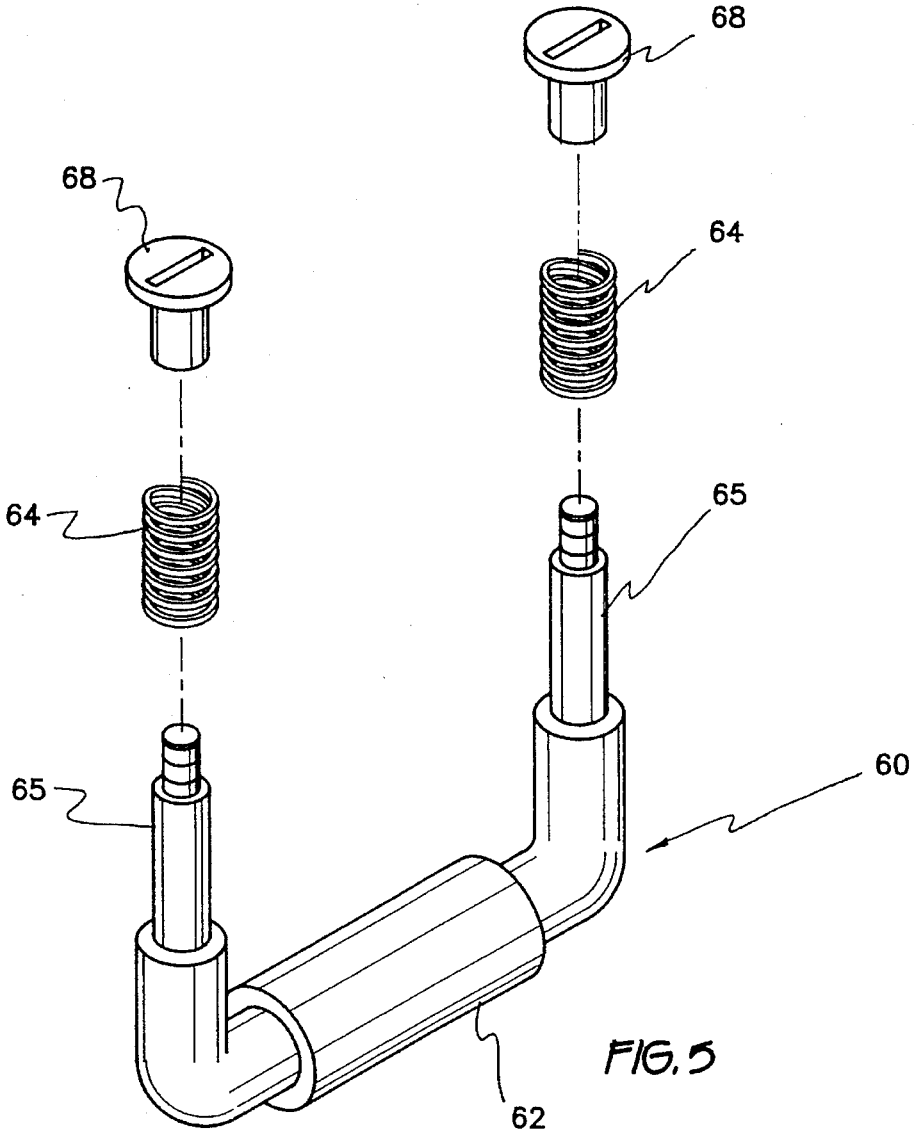
FIG. 5 is an exploded view of the biased roller.

Referring to FIGS. 4 and 5, the construction of the biased roller 60 will now be discussed. As mentioned above, the biased roller 60 has a roller portion 62. Extending outwardly and upwardly from the roller portion are a pair of arms 65. Best seen in FIG. 4, these arms fit into receiving bores 38 in the racket shank receiving portion 34. The receiving bores 38 include a necked down portion 39. Springs 64 fit over the arms 65 (as seen in FIG. 5) and after the arms 65 are fit into the receiving bores it can be seen in FIG. 4 that they extend through the necked down portion 39. The ends of the arms 64 are threaded and threaded caps 68 are attached thereto. Thus, the roller 60 is held in a fixed relationship to the racket shank receiving portion 34 and the roller portion 62 is urged by the springs 65 into engagement with the notch 70 in the racket shank 24. The exception to this is when the device is in the unlocked position (FIG. 3). In this unlocked position, the roller portion 62 can move into the roller receiving opening on the interior of the racket shank receiving portion 34 due to the travel release slot 72 in the interior of the locking sleeve 40 being aligned over the arms 65 and threaded caps 68 of the roller 60. As the roller portion 62 of the roller 60 moves from one notch 70 to another, the arms 64 and threaded caps 68 attached thereto move into the travel release slot 72 (in the direction indicated by directional arrow A2 in FIG. 3). When the proper notch 70 is engaged, the user simply moves the locking sleeve back into the position seen in FIG. 2 and the racket is ready for use with a new overall length. It should be noted that the springs 64, when the device 10 is in the unlocked position. Still urge the roller portion 62 of the roller 60 "downwards", that is towards the bottom of the notches 70, so that the arms 64 and caps 68 work against the bias of the springs 65 to extend into the travel release slot 72 as the roller changes from one notch 70 another.

The racket portion 20 could be made of various materials. Some users would prefer metal, others would prefer wood. The differences in the materials lead to differing characteristics in the feel of the device 10 when the ball is struck. It can be seen that the racket portion 20 and the grip portion 30 can be completely detached from one another. The locking sleeve 40 is moved into the unlocked position (shown in FIG. 3) and the O-ring seal 58 could be slid out of the annular exterior groove 59 and detached completely from the racket shank receiving portion 34. The device 10 could then be completely separated and a differing racket portion 20 could be attached by reversing the above steps.

In the same vein, various materials for the construction of the grip portion 30 could be used. polycarbonate, resins, high impact polymers, and the like could all be variously used without departing from the spirit of the invention.

An additional feature of the present invention is that the design of the locking sleeve assures that the centrifugal force generated by the stroke of the racket serves to maintain the locking sleeve in the locked position.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

I claim:

1. An adjustable handle for a tennis racket comprising:

a racket shank, a grip portion, said grip portion and said racket shank each including means for selectively engaging each other at a plurality of locations; and a locking sleeve, said locking sleeve overlying said racket shank and said grip portion, said locking sleeve being positionable to a first position whereat said racket shank and said grip portion are moveable in relation to one another, and where said locking sleeve is further positionable to a second position whereat said racket shank and said grip portion are fixed in relationship to one another; and wherein said selective engagement means includes a plurality of notches on said racket shank and a corresponding biased member attached to said grip portion, and where said biased member is selectively urged into one of said notches to hold said racket portion and said grip portion fixed in relationship to one another when said locking sleeve is in said second position.

* * * * *